US006932080B2

(12) United States Patent
Looman et al.

(10) Patent No.: US 6,932,080 B2
(45) Date of Patent: Aug. 23, 2005

(54) ARRANGEMENT OF BURNER AND HEAT EXCHANGER, AND AIR-HEATING APPARATUS

(75) Inventors: Lambertus Bernardus Gerardus Looman, Winterswijk (NL); Raymundes Gerardus Clemens Hilbers, Etten (NL)

(73) Assignee: Winterwarm B.V., Winterswijk (NL)

( * ) Notice: Subject to any disclaimer, the term of this patent is extended or adjusted under 35 U.S.C. 154(b) by 0 days.

(21) Appl. No.: 10/618,430

(22) Filed: Jul. 10, 2003

(65) Prior Publication Data

US 2004/0016426 A1 Jan. 29, 2004

(30) Foreign Application Priority Data

Jul. 10, 2002 (EP) ..... 02077787

(51) Int. Cl.[7] ..... F24H 3/00
(52) U.S. Cl. ..... 126/116 R; 126/91 R
(58) Field of Search ..... 126/116 R, 91 R, 126/91 A; 165/153, 170

(56) References Cited

U.S. PATENT DOCUMENTS 2,682,867 A * 7/1954 Cartter ..... 126/116 B
2,979,050 A * 4/1961 Costello ..... 126/104 R
4,412,523 A * 11/1983 Schreiber et al. ..... 126/92 C
5,199,416 A * 4/1993 Gumienny et al. ..... 126/522
5,623,918 A * 4/1997 Swilik et al. ..... 126/110 R
5,860,411 A * 1/1999 Thompson et al. ..... 126/116 A
6,308,702 B1 10/2001 Huyghe et al.

* cited by examiner

*Primary Examiner*—Alfred Basichas
(74) *Attorney, Agent, or Firm*—Townsend and Townsend and Crew, LLP

(57) ABSTRACT

Arrangement of a burner (2) and a heat exchanger (1), the heat exchanger (1) including a plurality of heat exchange elements (3) interconnected to each other with intermediate gaps, the heat exchanger (1) being arranged with an inlet (4') and an outlet (5'), the burner (2) being connected at the inlet (4') to the heat exchanger (1) for providing energy to the heat exchanger (1) by burning a fuel gas, the heat exchanger (1) being arranged, in use, for heat transfer firm an outer surface of the heat exchange elements (3) to process air as a secondary gas, the burner (2) being arranged to burn the fuel gas inside the heat exchanger (1), wherein the heat exchanger (1) is constructed from a high temperature material to allow, in use, heat transfer to the secondary gas by radiation of the heat exchange elements (3), the radiation being in a visible range of the spectrum, the heat exchanger having a surface temperature in the range of 450–1000° C.

11 Claims, 3 Drawing Sheets

ARRANGEMENT OF BURNER AND HEAT EXCHANGER, AND AIR-HEATING APPARATUS

FIELD OF THE INVENTION

The present invention relates to an arrangement of a burner and heat exchanger as defined in the preamble of claim 1. Also, the invention relates to an air-heating apparatus comprising such an arrangement of a burner and heat exchanger. Further, the invention relates to a method for such an air-heating apparatus.

PRIOR ART

Air-heating apparatuses are well known in the art for heating of large spaces such as storage warehouses and workshops. In such an air-heating apparatus a burner section and a heat exchanger section are separately present.

The burner section is used as energy source and provides energy in the form of heated matter at it's outlet to the heat exchanger section. The heated matter may be an exhaust gas or a fluid: most systems known in the art are gas-fired air heating apparatuses that use a gas burner device to burn a primary fuel gas (e.g., natural gas) and to produce high temperature exhaust gas as energy source.

In the heat exchanger section of gas-fired air-heating apparatuses the energy content of the high temperature exhaust gas is used to heat a secondary gas (i.e., room air or process air) which is to be distributed in the space to be heated. The heat exchanger section consists of heat exchanger elements through which the high temperature exhaust gas is guided internally and where heat exchange between the high temperature exhaust gas and the process air takes place at the outer surface of those heat exchange elements. The process air may be forced by a blower to flow across the outer surface of the heat exchanger elements to enhance the exchange of heat.

In relation to energy conservation and reduction of energy costs, the efficiency of air-heating apparatuses from the prior art may be regarded low. Mainly for historical reasons, the maximum temperature in the heat exchanging section is typically limited to about 450° C. Therefore the heat flux (heat flow per unit area) of an air-heating unit is low. To obtain a sufficiently large heat flow for adequate heating, the heat exchanger area of an air-heating unit must be large and consequently air-heating units from the prior art are relatively bulky. The actual flow needed relates to the size of the space to be heated and depends on the actual capacity of the air-heating apparatus. (In some cases more than one air-heating apparatus may be required in a particular space.) Disadvantageously, due to their bulky size, air-heating apparatuses reduce the useful floor (or wall) capacity of storage warehouses and the like.

SUMMARY OF THE INVENTION

It is an object of the present invention to provide an air-heating apparatus that has better energy efficiency than air-heating systems from the prior art.

Therefore, the present invention relates to an arrangement of a burner and heat exchanger as defined in the preamble of claim 1, characterised in that the heat exchanger is constructed from a high temperature material to allow, in use, heat transfer to the secondary gas by radiation of the heat exchange elements.

Further, the present invention relates to an air-heating apparatus comprising such an arrangement of a burner and a heat exchanger.

Advantageously, the present invention allows an increase of the surface temperature of the heat exchanger to well above 450° C. up to temperatures, e.g., up to 1000° C., preferably in the range of 700–800° C., where heat transfer is taking place substantially by radiation. A surface temperature of approx. 750° C. may be used in the air-heating apparatus according to the present invention. Due to the higher temperature of the high temperature exhaust gas the efficiency of heat transfer in the heat exchanger is strongly improved.

Also, by allowing high temperatures, the heat flux and heat transfer of a heat exchanger is strongly increased. Since the heat transfer is proportional to the cubic of the temperature difference between the incoming primary heat flow (i.e., high temperature exhaust gas) and secondary heat flow (i.e., process air), a two-fold increase of the temperature difference will result in an 8-fold increase of the energy in the outgoing secondary heat flow. As a consequence, for a given capacity of a heat exchanger, the heat exchanger in the air-heating apparatus according to the present invention can have a smaller size than a heat exchanger from the prior art. Advantageously, a more compact air-heating apparatus will need less floor- (or wall-) space than an air-heating apparatus from the prior art.

In this respect, high temperature materials may be defined as materials which can withstand exposure to temperatures above 450° C. during process time without a significant deterioration of their mechanical, physical and/or chemical properties. By using high temperature materials for the heat exchanger, the heat exchanger advantageously has improved thermal stability i.e., resistance to e.g., high temperature mechanical failure and high temperature corrosion.

In a further preferred embodiment, the position of the burner inside the heat exchanger favours both the increase of the working temperature and the size reduction of the apparatus, due to the fact that the high temperature exhaust gas is generated directly in the heat exchanger.

BRIEF DESCRIPTION OF DRAWINGS

Below, the invention will be explained with reference to some drawings, which are intended for illustration purposes only and not to limit the scope of protection as defined in the accompanying claims.

DESCRIPTION OF PREFERRED EMBODIMENTS

Figure 1:
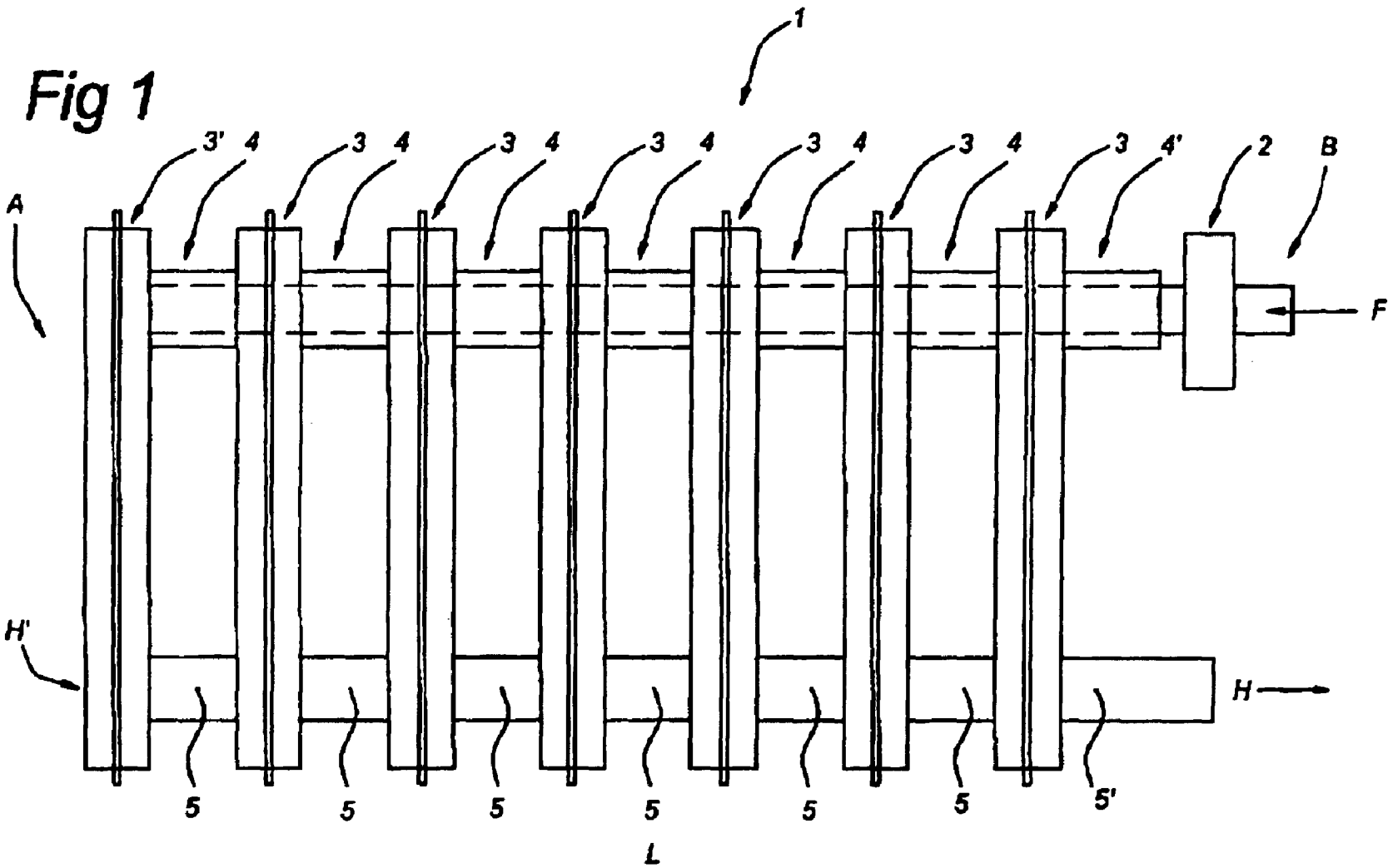
FIG. 1 shows a cross-sectional view of an arrangement of a burner and a heat exchanger according to the present invention.

FIG. 1 shows a cross-sectional view of an arrangement of a burner and a heat exchanger according to the present invention. The arrangement comprises a heat exchanger 1 and a burner 2. The heat exchanger 1 consists of a plurality of interconnected heat exchange elements 3 forming a lamellar structure. In this lamellar structure the heat exchange elements 3 have preferably a substantially rectangular shape and are connected gastight to each other with a gap in between two adjacent heat exchange elements 3. The heat exchange elements 3 comprise inlet duct parts 4 and outlet duct parts 5 for connecting to each other. An inlet duct part 4 and outlet duct part 5 are preferably integral parts of an element 3, but also may be separate parts for connection to a heat exchange element 3. In FIG. 1 the ducts 4, 5 are shown as tubular parts, but the ducts 4, 5 also may be heightened areas integrated in the heat exchanger element 3.

On one sidewall A of the heat exchanger 1 an end heat exchange element 3' is located which comprises an inlet duct part 4 and an outlet duct part 5 on only one of it's sides.

On the opposite sidewall B of the heat exchanger 1, the burner 2 is connected. The burner 2 is a gas-fired burner and is connected to an outer inlet duct part 4' of the heat exchanger 1. Outer inlet duct 4' may be provided with a flange for connecting the burner 2. The burner 2 receives fuel gas at a burner inlet F. A gas outlet H is located on the outer outlet duct part 5'. Outer outlet duct 5' may be provided with a flange for connecting other ducts.

When the burner 2 is in use, the burning process produces high temperature exhaust gas which are directed into the heat exchanger 1. The high temperature exhaust gas flows from the burner 2 through the inlet duct parts 4, the heat exchange elements 3, and the outlet duct parts 5 to the gas outlet H. In FIG. 1, the burner 2 is located at the same sidewall B of the heat exchanger 1 as the gas outlet H. It will be appreciated that the gas outlet H may be located at an opposite location H' at sidewall A of the heat exchanger 1.

In the heat exchanger 1 according to the present invention, the flow of process air to be heated is perpendicular to the drawing surface of FIG. 1.

Figure 2:
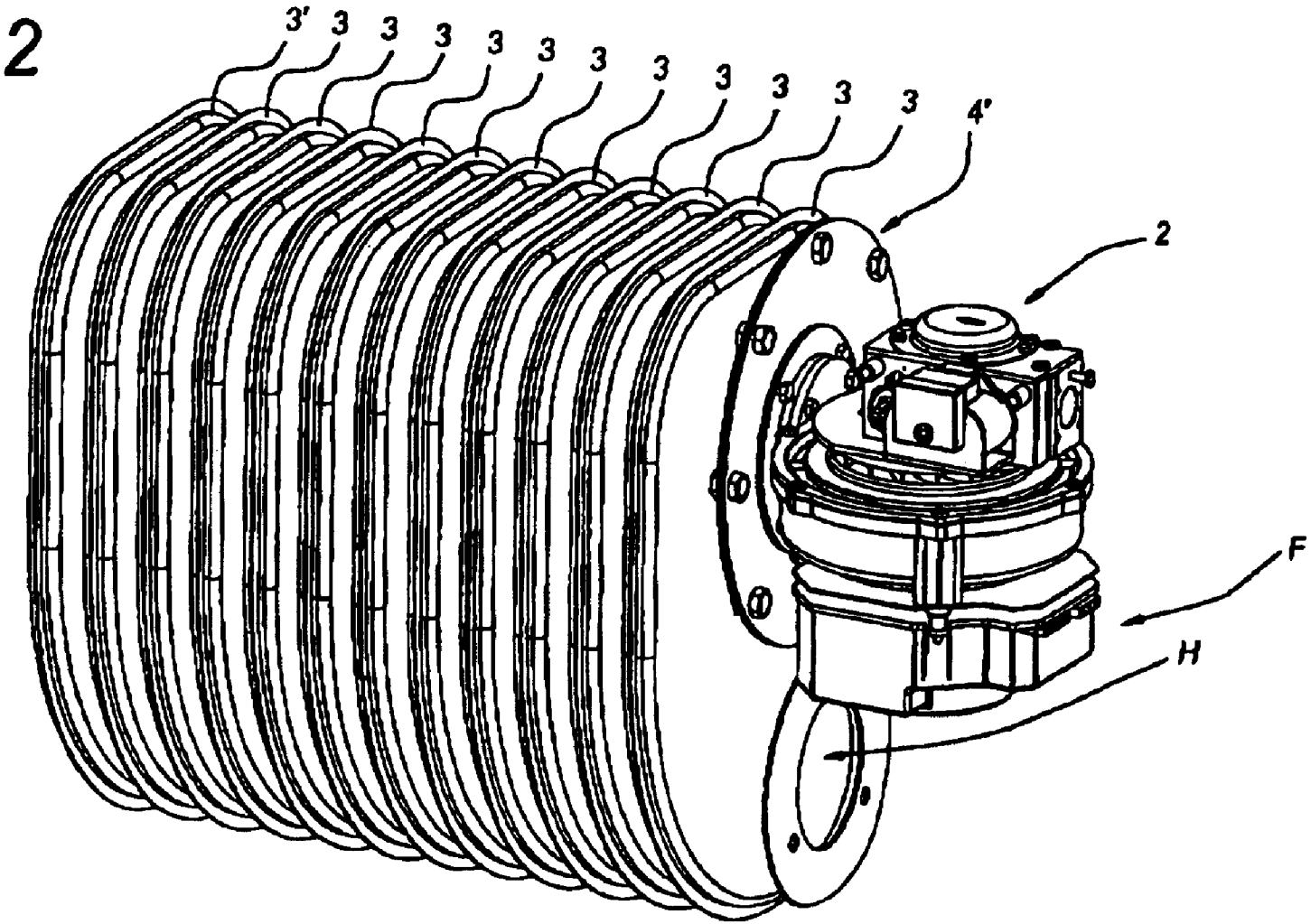
FIG. 2 shows a perspective view of an arrangement of a burner and a heat exchanger according to the present invention.

FIG. 2 shows a perspective view of an arrangement of the burner 2 and the heat exchanger 1 according to the present invention. In FIG. 2, entities with the same reference numbers refer to the same entities as shown in FIG. 1.

It is known that the larger the temperature difference between the relatively hot heat exchange elements 3 and the relatively cold incoming process air flow, the larger the heat transfer to the process air flow will be. Thus, to enhance the energy efficiency of the heat exchanger 1, increasing the surface temperature of the heat exchange elements 3 relative to the temperature of the incoming secondary gas is required.

Typically, in prior art air-heating apparatuses a surface temperature of approx. 450° C. is maintained during use of the apparatus. Most of the heat transfer is achieved at this temperature by convection (heat flow from the outer surface of the heat exchange elements 3 to the process air). To enhance the heat transfer and the heat flow, the surface temperature must be increased. In the present invention the surface temperature is preferably increased up to roughly 1000° C., preferably 700–800° C.

Actually, at this high temperature, the surface of the heat exchange elements will be hot enough to generate radiation in the visible range of the spectrum. Since the heat transfer is proportional to the cubic of the temperature difference between the incoming primary flow (here the hot surface at e.g., ~750° C. heated by the high temperature exhaust gas) and incoming secondary heat flow (the process air flow at e.g., ~25° C.), the increase of the temperature difference from 425' to 725' will result in an (almost) 5-fold increase of the energy in the outgoing secondary heat flow.

In the present invention it is recognized that increasing the surface temperature of the heat exchange elements 3 relative to the temperature of the incoming process air can be achieved by locating the burner 2 close to the heat exchanger 1, and by improving the thermal stability of the heat exchanger 1, mechanically, physically, and/or chemically.

In a preferred embodiment of the present invention, the burner 2 is integrated in the heat exchanger 1: The burner 2 is located inside the inlet duct parts 4 and preferably extends over a substantially large part of the length L of the heat exchanger 1.

To improve thermal stability at the high working temperature, the heat exchanger elements 3 are produced from high temperature materials, such as high temperature steels (e.g., a stainless steel) and high temperature alloys, which possess sufficient mechanical strength and corrosion resistance at high temperature.

Furthermore, due to the increase of the energy in the outgoing secondary heat flow (process air heated in the heat exchanger 1), the heat exchanger 1 according to the present invention can be more compact and have smaller dimensions than a heat exchanger from the prior art, for a given heat capacity. Typically, compared to the size of air heating apparatuses from the prior art, an air heating apparatus comprising the arrangement of burner and heat exchanger according to the present invention occupies a volume which is approximately 50% smaller. As a consequence, less floor space or wall space is needed for placement of an air-heating apparatus according to the present invention.

The burner 2 in the arrangement of the present invention is preferably a pressurised gas-fired burner.

The arrangement of burner and heat exchanger is formed in such a way that energy losses of the high temperature exhaust gas during transfer from burner to heat exchanger are as minimal as possible. In the preferred embodiment, the burner 2 may be integrated in the heat exchanger.

Further, the arrangement of burner and heat exchanger is formed in such a way that a distribution of the heated gas along the direction L of the heat exchanger 1 is obtained that provides a substantially uniform heating of the heat exchange elements 3, i.e., each element 3 has substantially the same temperature during operation.

The burner 2 further may comprise a connector 40 (e.g., a flange) for connecting to the outer inlet duct 4' of the heat exchanger 1.

The burner 2 shown here is a pressurised gas-fired burner. It is noted that the burner may also be a burner for use at atmospheric pressure.

Also, the burner 2 may be arranged as a modulating burner, with a modulation proportional to a given temperature difference between e.g. a measured process air temperature and a temperature set-point.

It is noted that various types and shapes of the burner (e.g. a rod-shaped burner element) may be used in accordance with the present invention.

In the burner and heat exchanger arrangement of the present invention, a further improvement of the energy efficiency is obtained by extended cooling of the heated gas in the heat exchanger elements 3 from initially approx. 1000° C. to well below 100° C. by providing a large flow of process air through the heat exchanger 1.

To this extent, the width of the heat exchanger elements 3 is small relative to the width of the gap in between adjacent heat exchange elements 3. A heat exchanger 1 according to the present invention may comprise heat exchanger elements 3 having for example a height of 35 cm, a depth of 25 cm, and width of approx. 1 cm. In the present invention, the ratio of the element width and the gap width is substantially larger than 1:1, preferably, 1:3 or more.

Figure 3:
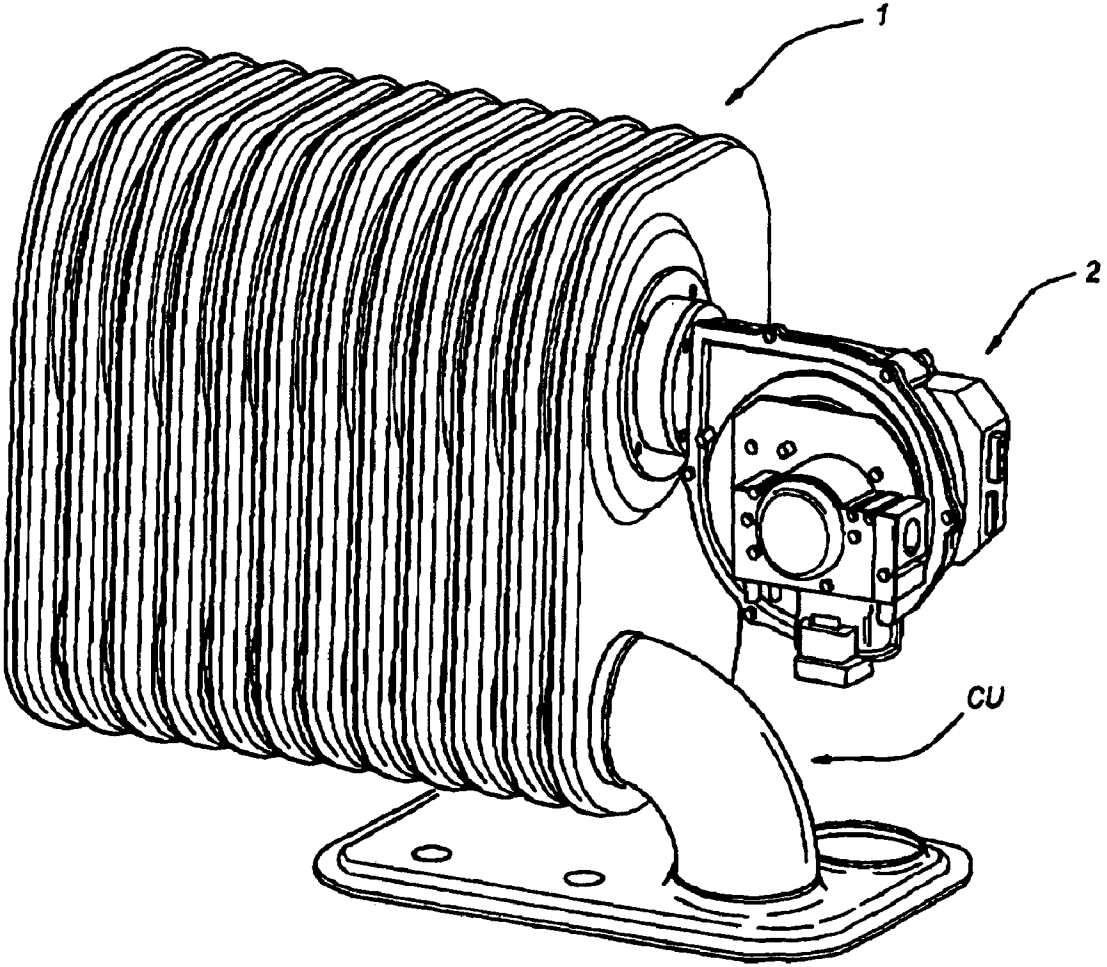
FIG. 3 shows a perspective view of the burner and heat exchanger arrangement in a further embodiment.

FIG. 3 shows a perspective view of the burner and heat exchanger arrangement in a further embodiment. In FIG. 3, entities with the same reference numbers refer to the same entities as shown in the preceding figures.

In the further embodiment of FIG. 3, the burner and heat exchanger arrangement comprise an additional condensation unit CU located at the gas outlet H. Advantageously, the condensation unit CU further increases the energy efficiency of the burner and heat exchanger arrangement by condensation of moisture from the heated gas.

Finally, it is noted that due to the compact size of an air-heating apparatus according to the present invention, such an air-heater may also be applied as an air curtain at the entrance of e.g., a building. In comparison to prior art air curtains powered electrically or by heated water, an air-heater according to the present invention has the advantage that the overall energy efficiency is higher, since no additional conversion step (to electricity or to heated water) is necessary.

What is claimed is:

1. Arrangement of a burner (2) and a heat exchanger (1), said heat exchanger (1) comprising a plurality of heat exchange elements (3) interconnected to each other with intermediate gaps, said heat exchanger (1) being arranged with an inlet (4') and an outlet (5'), said burner (2) being connected to said inlet (4') to said heat exchanger (1) for providing energy to said heat exchanger (1) by burning a fuel gas, said heat exchanger (1) being arranged for heat transfer from an outer surface of said heat exchange elements (3) to process air as a secondary gas, said burner (2) being arranged to burn said fuel gas inside said heat exchanger (1) wherein said burner (2) comprises a burner element, being located inside said heat exchanger (1); said burner element being arranged to provide a preferential direction for transfer of said energy through said heat exchange elements (3), and said heat exchanger (1) is constructed from a high temperature material to allow heat transfer to said secondary gas by radiation of said heat exchange elements (3), said radiation being visible radiation, said heat exchanger having a surface temperature in the range 450–1000° C.

2. Arrangement according to claim 1, wherein said high temperature material comprises a high temperature steel or a high temperature alloy.

3. Arrangement according to claim 1, wherein the ratio of the width of one of said heat exchange elements and the width of one of said intermediate gaps is at least 1:3.

4. Arrangement according to claim 1, wherein said burner (2) is a pressurised burner.

5. Arrangement according to claim 1 wherein said burner (2) is a modulating burner.

6. Arrangement according to claim 1 wherein a condensation unit (CU) is connected at said outlet (5') of said heat exchanger (1).

7. Method to be carried out by an arrangement according to claim 1, wherein the method comprises:

heating said outer surface of said heat exchange elements (3) to a high surface temperature to allow heat transfer to said secondary gas by radiation of said heat exchange elements (3), said radiation being visible radiation said heat exchanger having a surface temperature in the range of 450–1000° C.

8. Method according to claim 7, wherein said high surface temperature is a surface temperature above 450° C.

9. Method according to claim 8, wherein said surface temperature is in the range of 450–1000° C.

10. Method according to claim 9, wherein said surface temperature is in the range of 700–800° C.

11. Air-heating apparatus comprising an arrangement of a burner (2) and a heat exchanger (1) according to claim 1.

* * * * *